US008564528B1

(12) United States Patent
Chen et al.

(10) Patent No.: US 8,564,528 B1
(45) Date of Patent: Oct. 22, 2013

(54) LCD IMAGE COMPENSATION FOR LED BACKLIGHTING

(75) Inventors: Tao Chen, Shanghai (CN); Bob Zhang, Santa Clara, CA (US); James Zhou, San Jose, CA (US); Neil D. Woodall, Newport Beach, CA (US)

(73) Assignee: Pixelworks, Inc., Portland, OR (US)

( * ) Notice: Subject to any disclaimer, the term of this patent is extended or adjusted under 35 U.S.C. 154(b) by 163 days.

(21) Appl. No.: 13/110,745

(22) Filed: May 18, 2011

(51) Int. Cl.
*G09G 3/34* (2006.01)

(52) U.S. Cl.
USPC ..... 345/102

(58) Field of Classification Search
None
See application file for complete search history.

(56) References Cited

U.S. PATENT DOCUMENTS

2012/0154459 A1* 6/2012 Otoi et al. ..... 345/690

FOREIGN PATENT DOCUMENTS

WO WO 2011040084 A1 * 4/2011

* cited by examiner

*Primary Examiner* — Joseph Haley
(74) *Attorney, Agent, or Firm* — Marger Johnson & McCollom PC

(57) ABSTRACT

A method, includes receiving original image data having a first resolution, dividing the original image data into zones based upon a second resolution, wherein the second resolution corresponds to a resolution of backlight elements, determining a backlight value for each zone, and adjusting the original image data in each block to compensate for the backlight value for each zone to produce compensated image data, wherein adjusting the original image data comprises using the backlight value and an original image data value as indexes into at least one look-up table to acquire compensated image data. An apparatus has a source of original image data, a display panel of individual elements, a backlight of individual lighting elements, at least one look-up table having compensated image data, and a processor to determine a backlight value for each individual lighting element, and adjust the original image data to compensate for the backlight value and produce compensated image data by using the backlight value and an original image data value as indexes into the look-up table.

13 Claims, 9 Drawing Sheets

LCD IMAGE COMPENSATION FOR LED BACKLIGHTING

BACKGROUND

Liquid crystal display systems typically use backlights. Traditionally, the backlight produced constant and even light, with the liquid crystal cells controlling the brightness of the image. However, constant backlights have some disadvantages in high power consumption especially at high ambient light, heat generation and reduction in the dynamic range of the display. One solution for better control of the backlight replaces the constant backlight panel with an array of solid-state light emitters, such as light-emitting diodes (LEDs), with the number of LEDs being far less than the number of LCD elements. This allows for adjustment of the backlight according to the brightness in regions of the image, rather than the overall brightness of the entire image.

When using a backlight, the input image is typically downsampled to a resolution that corresponds to the LED array size. There are several methods that can be used to down sample the data. One method lowpass filters the data before downsampling and then adjusts that data to take into account the amount of light leaking from adjacent LED zones, where a zone consists of the area that is in front of the LED. Each zone represents the LCD elements/pixels closest to a particular LED, or group of LEDs, that are controlled together. To save driver cost and allow for a thinner panel a zone might consist of several LEDs that are controlled together so that they act like a single LED at a larger distance from the LCD panel.

Another method controls the LED value based on the maximum image data value for an LED zone. Another method might look at the histogram data of the input image associated with the zone. In any of the above approaches, the zone area might also be increased so that it overlaps with adjacent zones. Some systems may also apply a spatial or temporal weight to the data. These approaches represent just some of the ways of calculating the LED values.

However they are determined, once one has the LED values for the LED array, the system needs to adjust the input image pixels to achieve a desired image value. A typical desired image value is the input image value. The desired value results from the LED backlight illumination at a pixel multiplied by the transmittance of the pixel.

When the dynamic range of a display is increased, it may also be desirable to increase the dynamic range and/or adjust the look of the image to take advantage of the increase. In addition, because the frequency response of the LED resolution is much lower than the input image compromises might be required to reduce the level of artifacts. These compromises might result in an LED illumination too low to allow the reproduction of the original image. For example, it might require a pixel transmittance of greater than 100% which is impossible. In the current art, a value corresponding to a transmittance of greater than 100% requires either a soft clipping circuit or results in areas of the image with no detail.

DETAILED DESCRIPTION OF THE EMBODIMENTS

Figure 1:
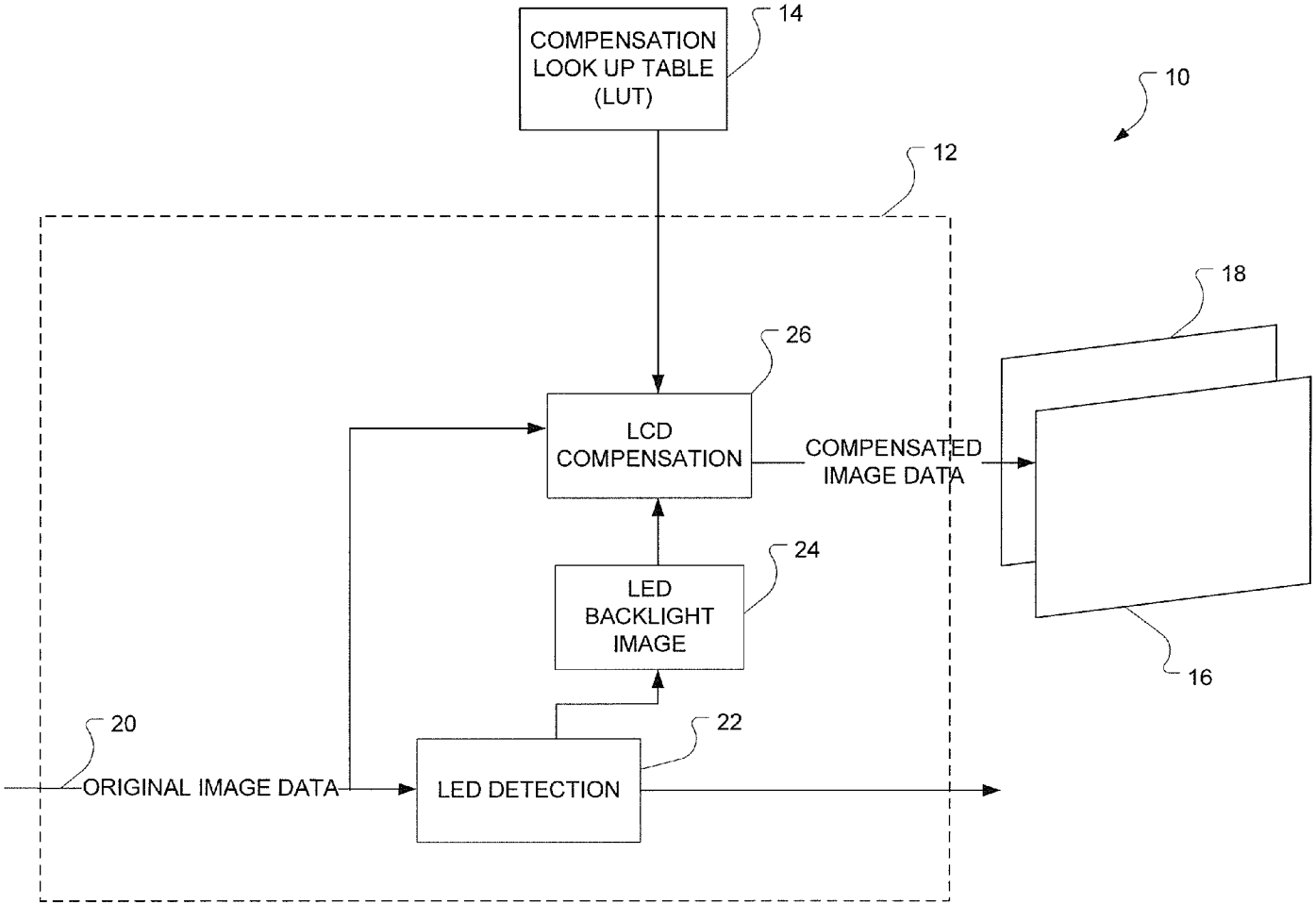
FIG. 1 shows a schematic of an image data processing circuit performing LCD-based image compensation.

FIG. 1 shows an embodiment of a display system having a backlit display panel. In, an LCD display system, the pixel luminance perceived by the user is the product of the backlight intensity and the panel transmittance (the amount of light transmitted by the panel). In a local dimming application, the backlight intensity varies based on the intensity of the individual LED's $$\text{luminance of a pixel}=\text{LED response}*\text{LCD response}=\text{LED}^{\alpha}*\text{LCD}^{\gamma}$$

where $\alpha$ is usually close to 1 and $\gamma$ is usually between 2 and 3, LED response, also called LED backlight image, has the resolution of the input LCD image. This may be obtained by a convolution of the LED array with point spread function (PSF) of the LED. The resolution of LED array is always limited to less than the LCD array.

The display system 10 has at least one processor 12 to perform compensation for the backlight. The display system also has a compensation look-up table (LUT) such as 14 to provide the necessary adjustment to the original image data to produce compensated image date. The original image data enters the processor from a source of image data.

In one embodiment, the source of image data consists of a video processor that generates the image data and processor 12 would be a post-processor. In another embodiment, the source of the image data may be the same video processor that also produces the compensated image date.

Similarly, the discussion here may refer to the image data as LCD image data, with the understanding that the image data may be for any pixilated display that uses an external light source. No limitation is intended, nor should any be implied, to LCD image data.

As will be discussed in more detail later, the processor 12 generally receives the original image data through the source 20. The LED detection module 22 calculates or otherwise determines the values of the LED array based on the original image data. Using the values of the LED array and a point spread function of the LEDs; the backlight image can be estimated.

Generally, the LED array 18 will have a much lower resolution than the image panel 16. For example the image panel may have a resolution of 1920×1280 pixels, while the LED array may have a resolution of 10×8 LED elements. Generally, the LCD pixels will be divided into zones, which may or may not overlap, with each zone being associated with one of the LED elements.

Generally, it is desirable for the perceived luminance after backlight dimming is identical to the perceived luminance without backlight dimming, such as:

$$\text{luminance}=\text{LED}^{\alpha}\text{LCD}^{\gamma}=(\text{LED}')^{\alpha}(\text{LCD}')^{\gamma}$$

where LED' and LCD' are adjusted LED image value and the adjusted LCD image value, respectively and LED and LCD are values required without local dimming. Typically, the original image data needs modification before sending to the display to compensate for different LED backlight image values. Using the above formula for luminance, the LCD' or compensated image data should be:

$$LCD' = \left(\frac{LED^{\alpha} LCD^{\gamma}}{(LED')^{\alpha}}\right)^{\frac{1}{\gamma}} = \left(\frac{LED}{LED'}\right)^{\frac{\alpha}{\gamma}} LCD$$

where LED' and LCD' are adjusted LED image value and the adjusted LCD image value, respectively. In order to apply the $LCD^{\alpha}$, the image data values have to first be converted to luminance values, and the $LCD^{\alpha}$ application involves another look-up table.

Figure 2:
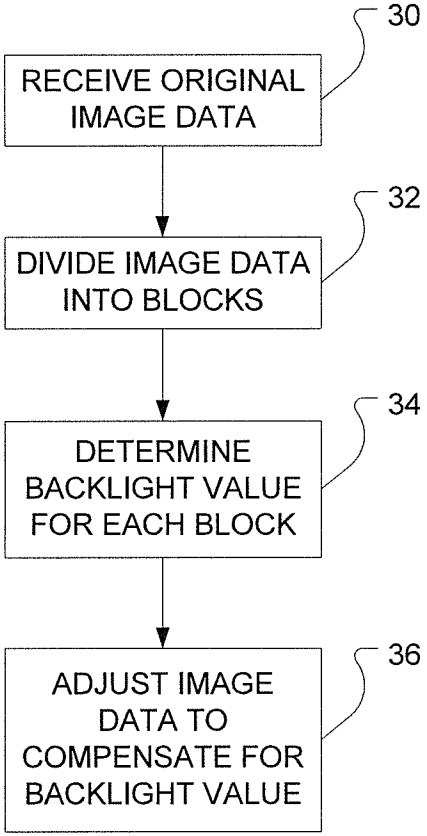
FIG. 2 shows a flowchart of an embodiment of a method of LCD-based compensation for an LED backlight display system.

Currently, most approaches attempt to adjust the brightness of the LED based upon the values of the image content within the zone. This either results in a loss of detail or noticeable light leakage in areas that are mostly dark. For example, if the LED is not bright enough, many of the higher value LCD values are mapped to the maximum LCD value, resulting in a loss of detail in areas that are significantly brighter than the average image pixel in that LED zone (note, that this is not the same as white or high brightness). However, it is possible, using the above system, to adjust the image data values in the original image data to compensate for the LED values. One may think of it as LCD-based compensation instead of LED-based compensation. FIG. 2 shows an overview of such an approach.

In FIG. 2, the system receives the original image data at 30. The image data is then divided into zones corresponding to the LED light sources at 32. The system then determines the backlight value for each zone at 34. Using the backlight value, the original image data is then adjusted to compensate for the backlight value at 36.

Determination of the backlight value for a particular region may take many forms. For better luminance-preserving, the max LCD value of this region can be taken as the LED level. For more power-saving and less artifacts of LED halo and LED flicker, the average LCD of the region can be taken as the LED level. A histogram based approach allows for a blending between the two methods to optimize the tradeoffs. The blending method calculates the LED level by blending the average LCD value and the max LCD value based on histogram statistical information of the LCD region, such as:

$$\text{LED level} = w*\text{LCD_avg} + (1-w)*\text{LCD_max},$$

where w is the blending weight. LCD_avg may calculated by averaging LCD, or a percentile value, where the higher percentile values are close to a maximum value, or a blend. LCD_max is calculated by max LCD value.

LCD compensation preserves luminance before and after LED backlight dimming. However, if the LED value is not large enough, image detail will be lost. But, LCD-based compensation can always reduce the detail loss in white region.

Figure 3:
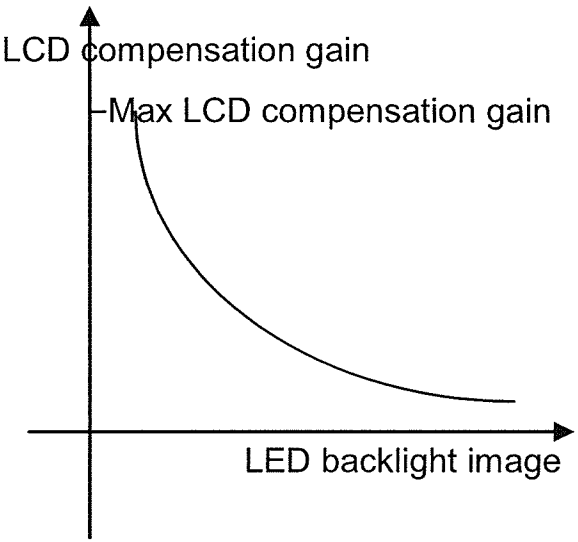
FIG. 3 shows a graph of LCD compensation gain versus LED backlight image values.

In performing LCD-based compensation, or LCD-compensation, one must take into account the compensation gain curve for an LCD value. For large LED backlight values, there should be little LCD compensation gain; for small LED backlight values, there should be large LCD compensation gains. FIG. 3 shows a compensation gain curve demonstrating this relationship.

Figure 4:
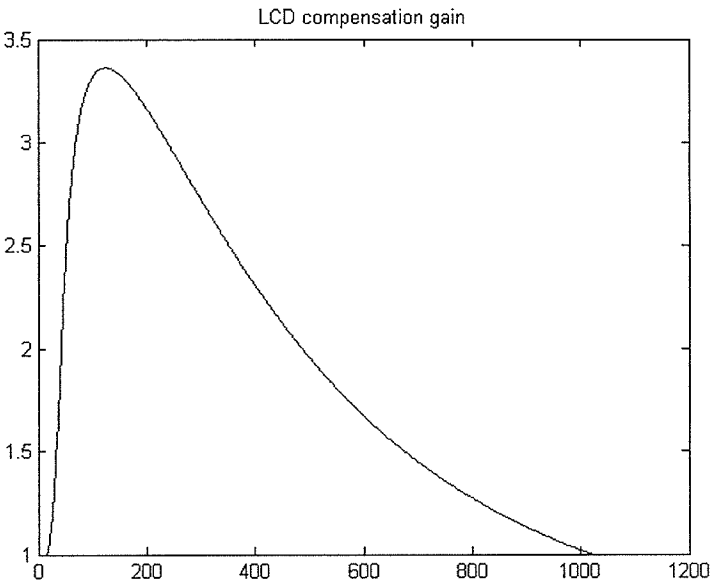
FIG. 4 shows graphs of compensated LCD image data and corresponding gain.
Figure 4:
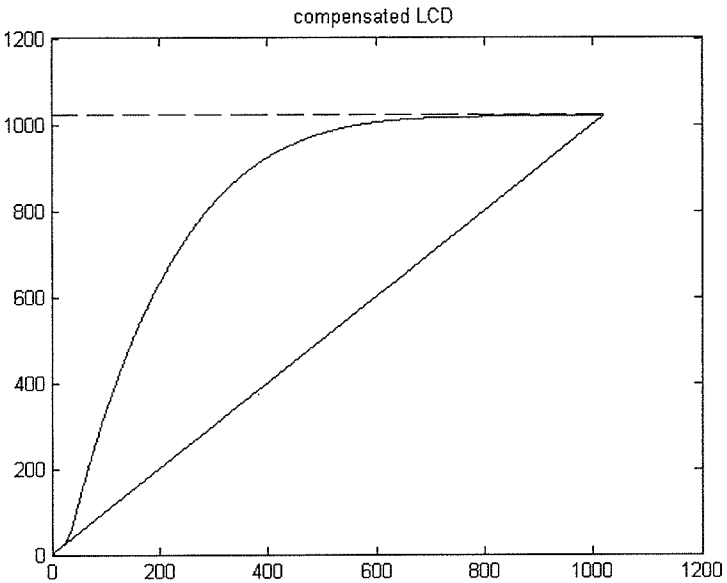

The curve from original LCD value to compensated LCD value can be first designed. The left part of FIG. 4 shows an example. The curve defines the upper limit of LCD compensation for each the original LCD value when the value of LED backlight image is smallest. Because the curve is LCD-to-LCD and the upper limit of LCD compensation, soft clipping of compensated LCD is easy to implement. Based on LCD-to-LCD compensation curve, the gain value of LCD compensation can be calculated by $$\frac{LCD'}{LCD}$$

shown in FIG. 4 on the right. For hardware implementation, the LCD compensation gain value can be stored into one or more LUTs.

In FIG. 4, the straight line is the LCD image data values. In this figures the X axis is the original pixel value (LCD), the Y axis is the adjusted value (LCD'). Each curve in the FIGS. 4-7 are for a given LED' value. The curve in FIG. 3 represents the max LCD compensation gain for a given LED' value (X-axis). The values in FIG. 3 correspond to the line 42 in FIGS. 5-7. The dash lined 40 in FIGS. 4-7 are represented by equivalent gains in the corresponding figure on the left hand side. Note, that in FIGS. 4-7, when the LCD values are very small, the gain is also smaller than expected. This increases the apparent dynamic range of the input signal by making blacks look blacker.

Seen from FIG. 4, the max compensation gain is between 3 and 3.5. When the LCD image data value is very small, the compensation gain of LCD is very low and less than max compensation gain. The operation can expand dark level and benefit the noise suppression of dark region. When the LCD value is high, the compensation of LCD also needs control. Otherwise the compensated values of many large LCD values will exceed max LCD values and be clipped to max LCD value. This is shown in FIG. 5.

Figure 5:
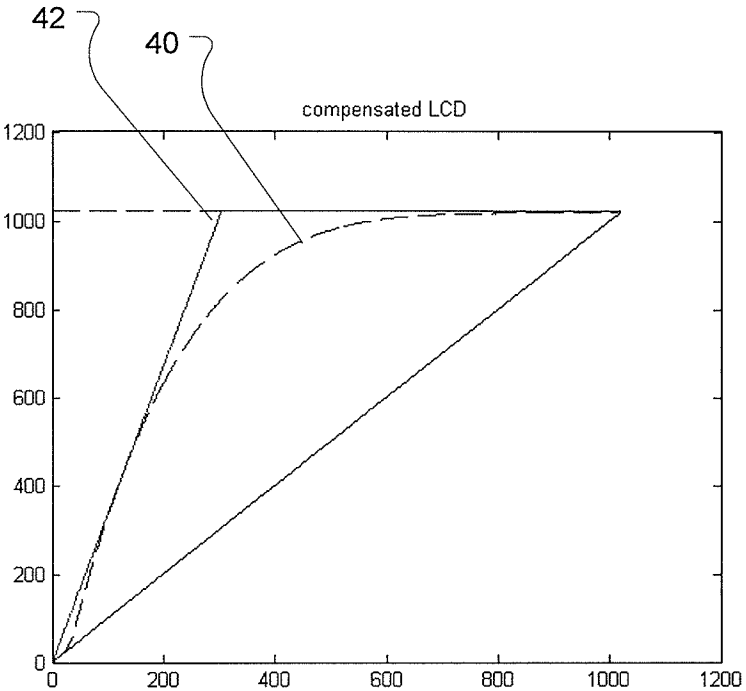
FIGS. 5-7 show graphs of examples of gain in LCD-compensated image data and the resulting LCD-compensated image data compared to LED-compensated image data.
Figure 5:
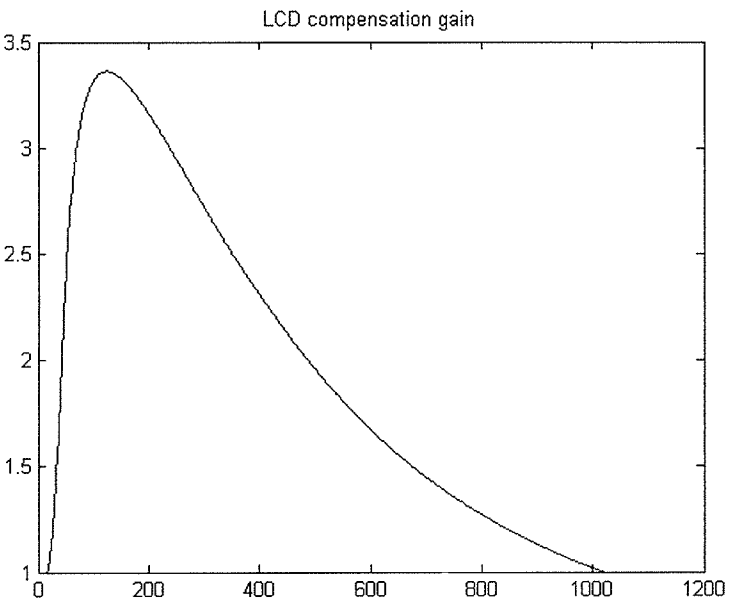
Figure 6:
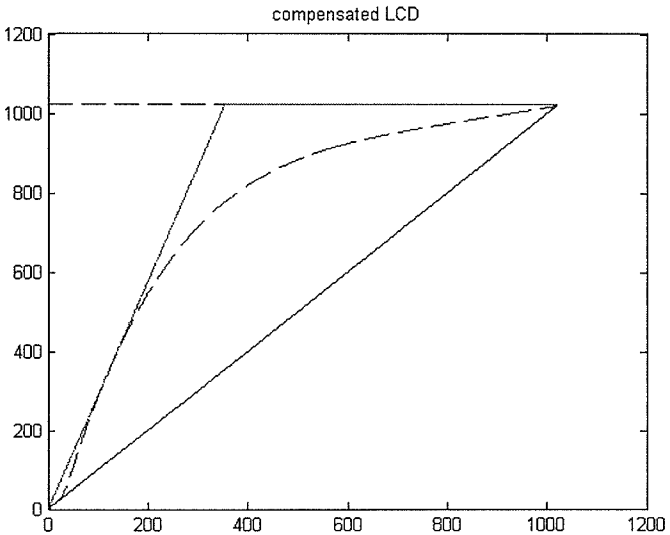
Figure 6:
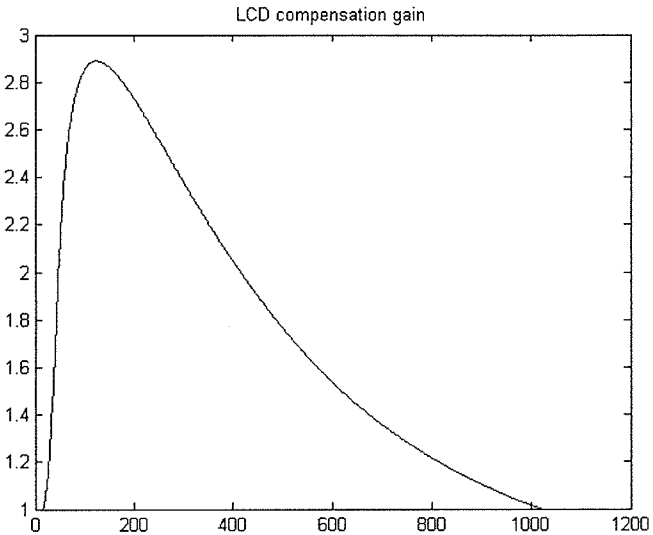
Figure 7:
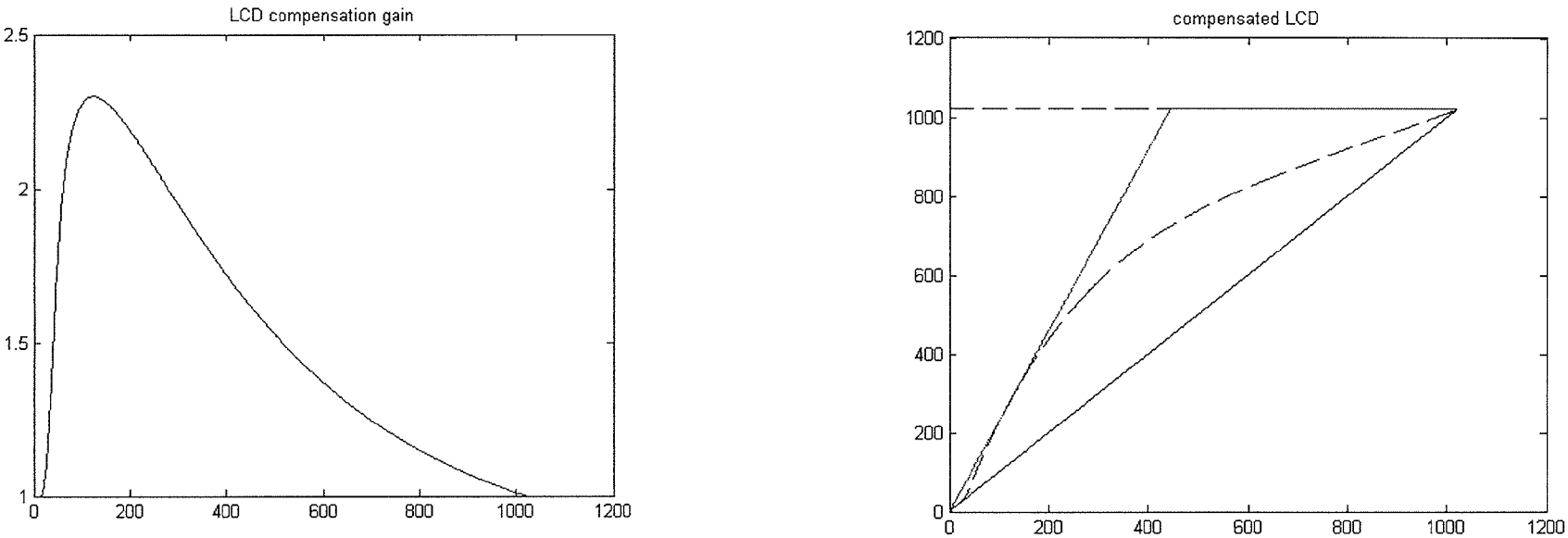

The left curve of FIG. 5 shows the gain compensation. The right curve of FIG. 5 shows the LCD-based compensation curve 40 compared to the LED-based compensation curve 42. In further figures, the LED-based compensation curve for each will demonstrate this clipping behavior, where many large LCD values will exceed the maximum possible LCD value and be clipped to that value. As can be seen by comparing the two curves, the LCD-based compensation curve will not suffer from detail loss in the high gain regions. FIGS. 6 and 7 give examples of compensation curves with different LED image values. With the LED values increasing from FIG. 5 to FIG. 6 to FIG. 7.

As mentioned above with regard to FIG. 3, for each LCD value, a degressive curve about the LED image value can be defined. One may use a two-dimensional (2D) LUT with the LED backlight image value and the LCD image data value as indexes into the table. The compensation formula is:

$$\text{LCD}' = \text{LCD} * \text{2D LUT}(\text{LED}', \text{LCD}),$$

where LCD' is the compensated LCD image value, LCD is the original LCD image value, LED' is the calculated backlight image with same resolution as original LCD image If the decrease of LCD compensation gain varied with LED image does not depend on the LCD image value, the 2D LUT of LCD and LED can be degraded into 2 1D LUTs, an LCD compensation LUT and a Weight LUT. The LCD compensation LUT decides the upper limit of LCD compensation gain when LED image is smallest, as discussed above, and shown in FIG. 4.

Figure 8:
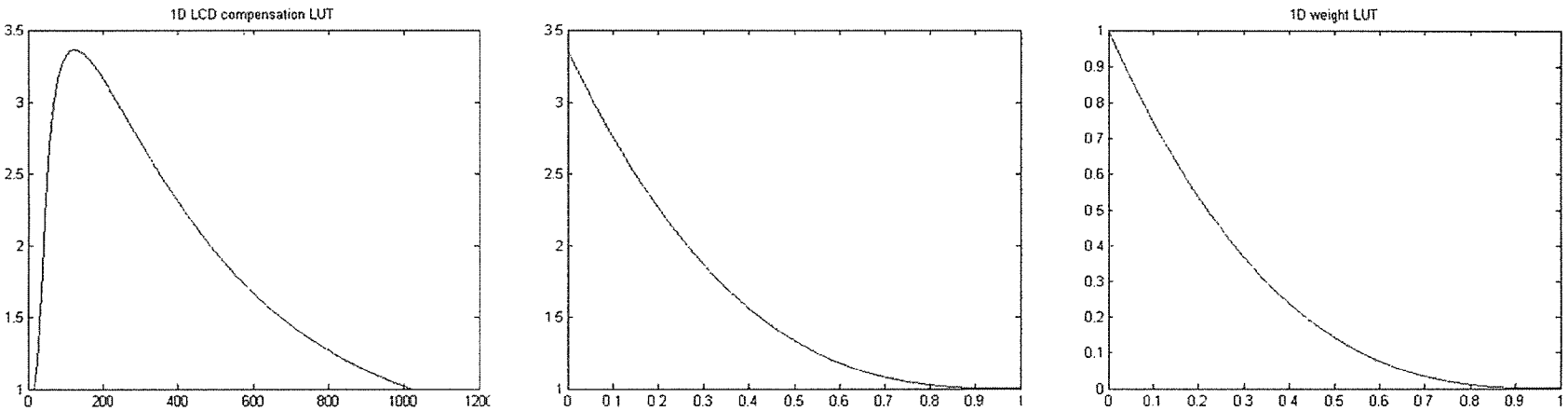
FIG. 8 shows an embodiment of a one-dimensional LCD compensation curve, a decreasing function of an LED image and a one-dimensional weighting curve.

The Weight LUT stores the weight to LCD compensation gain with the smallest LED image value. The 1D Weight LUT is a function of LED image value and is independent of the LCD image value. For a LED backlight image value LED', the weight is calculates from the equation:

$$f(LED')=weight*(max_gain_compensation-1.0)+1.0,$$

$$weight=(f(LED')-1.0)/(max_gain_compensation-1.0),$$

where max_gain_compensation, which should be greater than 1.0, is the max of 1D LCD compensation LUT. For example in the right curve of FIG. 4, the value is 3.36. The function $f(LED')$ is a degressive function about LED image value LED' such as $$\left(\frac{LED}{LED'}\right)^{\frac{\alpha}{\gamma}}$$

shown previously and the curve in FIG. 3 and should be limited by the value max_gain_compensation. From the above weight formulas, the weight for each LED' is calculated after finding the value from the 1D LCD compensation LUT and $f(LED')$ is designed by user. FIG. 8 gives an example of 1D LCD compensation LUT, decreasing function of LED image $f(LED')$, and calculated 1D Weight LUT.

Figure 9:
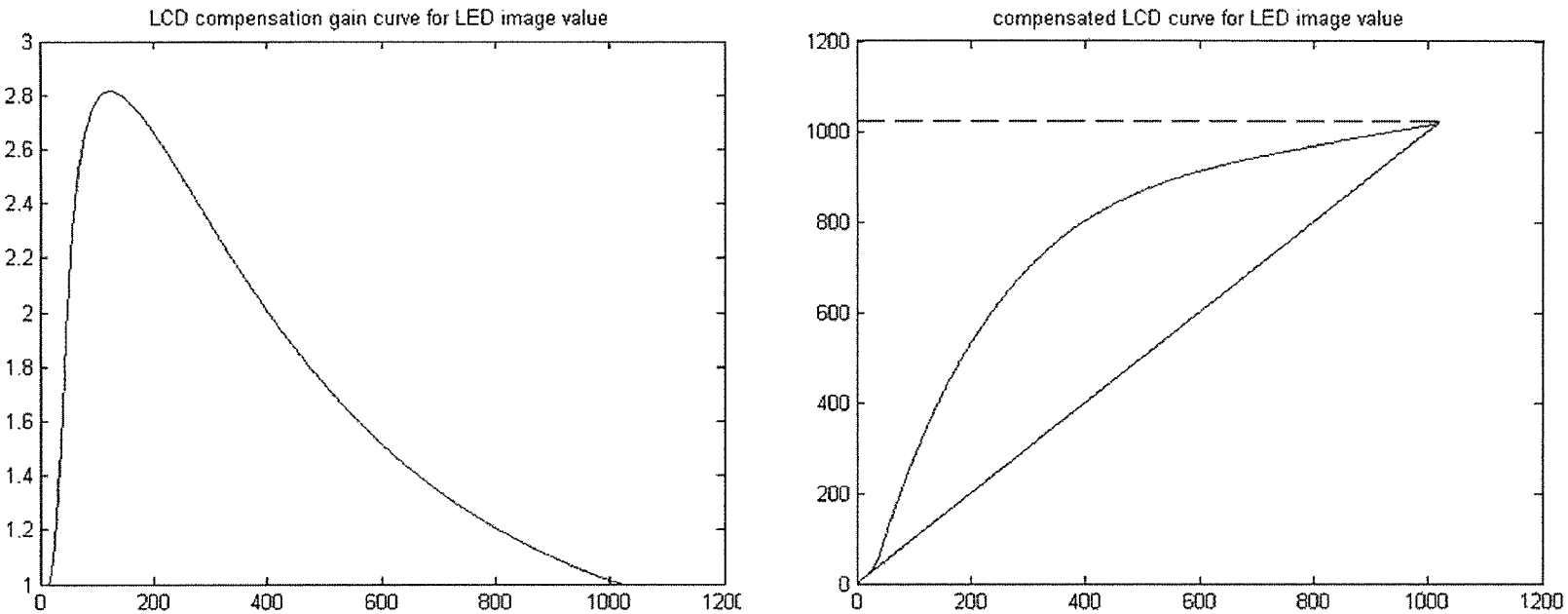
FIGS. 9 and 10 show examples of LCD compensation gain curves and results for two different LED image values.
Figure 10:
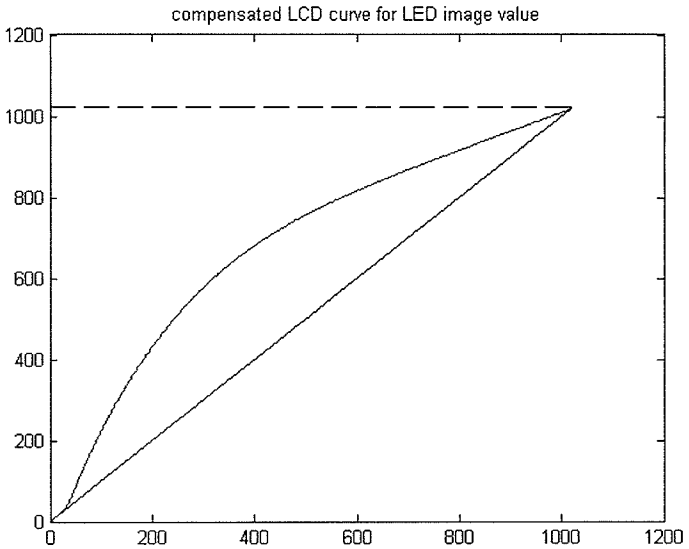
Figure 10:
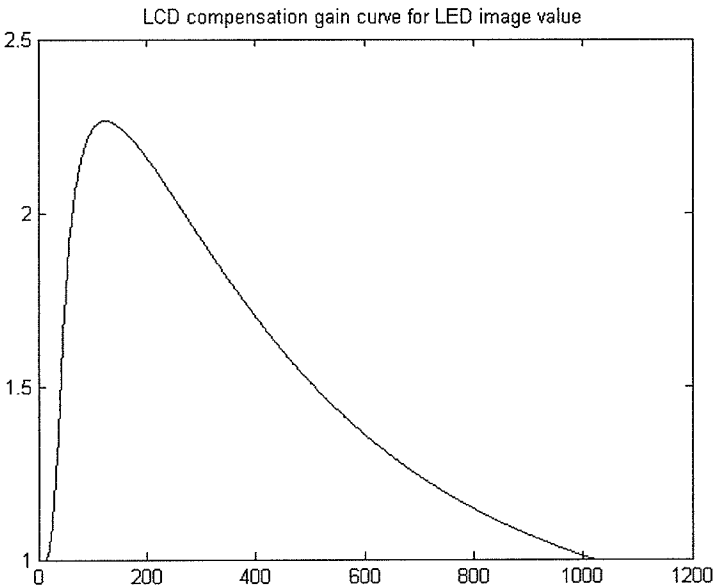

The compensation formula is as follows:

$$LCD'=LCD*LCD_gain_compensation,$$

where LCD_gain_compensation=1D Weight LUT(LED')*(1D LUT(LCD)−1.0)+1.0, LCD' is compensated LCD image value, LCD is the original LCD image value, and LED' is calculated backlight image with same resolution as original LCD image. When the LED image is smallest, the value of Weight LUT should be 1, compensation gain is the max from LUT(LED'). When the LED image value is max, the value of the Weight LUT should be zero and compensation gain is 1, meaning no compensation FIGS. 9 and 10 show two examples based on the 1D LCD compensation LUT and 1D Weight LUT of FIG. 8. FIGS. 9 and 10 show two calculated LCD compensation gain curves and two calculated compensated LCD results for two different LED image values. Corresponding values of the 1D Weight LUT are 0.7682 for FIG. 9 and 0.5358 for FIG. 10.

In this manner, either a 2D LUT or 2 1D LUTs can provide LCD-based compensation for LED backlighting. This approach prevents detail loss in high gain areas of the image data, as well as expansion of the dark level and noise suppression in the darker regions.

Thus, although there has been described to this point a particular embodiment for a method and apparatus for image data based compensation for an LED backlight, it is not intended that such specific references be considered as limitations upon the scope of this invention except in-so-far as set forth in the following claims.

What is claimed is:

1. A method, comprising:

receiving original image data having a first resolution;

dividing the original image data into zones based upon a second resolution, wherein the second resolution corresponds to a resolution of backlight elements;

determining a backlight value for each zone and a backlight image value; and adjusting the original image data in each block to compensate for the backlight value for each zone to produce compensated image data, wherein adjusting the original image data comprises using the backlight image value and an original image data value as indexes into a two-dimensional look-up table to acquire a compensated image data.

2. The method of claim 1, wherein receiving image data having a first resolution comprises receiving image data for a liquid-crystal device display.

3. The method of claim 1, wherein determining the backlight value for each zone comprises setting the backlight value to a maximum image data value for the zone.

4. The method of claim 1, wherein determining the backlight value for each zone comprises setting the backlight value to an average image data value for the zone.

5. The method of claim 1, wherein determining the backlight value for each zone comprises blending of an average image data value and a maximum image data value for the zone.

6. The method of claim 5, wherein blending the average image data value and the maximum image data value comprises providing a weight factor based upon a histogram of the zone.

7. An apparatus, comprising:

a source of original image data;

a display panel of individual elements;

a backlight of individual lighting elements;

a two-dimensional look-up table having compensated image data;

a processor to:

determine a backlight image value for each individual element; and adjust the original image data to compensate for the backlight value and produce compensated image data by using the backlight image value and an original image data value as indexes into the two-dimensional look-up table.

8. The apparatus of claim 7, wherein the processor comprises a video processor.

9. The apparatus of claim 7, wherein the processor comprises a post-processor.

10. The apparatus of claim 9, wherein the display panel comprises a liquid crystal device panel.

11. The apparatus of claim 7, wherein the processor is further to multiply the weight by the initial compensated image data value to determine produce the compensated image data.

12. A method, comprising:

receiving original image data having a first resolution;

dividing the original image data into zones based upon a second resolution, wherein the second resolution corresponds to a resolution of backlight elements;

determining a backlight image value for each zone and a backlight image value; and adjusting the original image data in each block to compensate for the backlight value for each zone to produce compensated image data, wherein adjusting the original image data comprises:

using the backlight image value to access a first one-dimensional look-up table to acquire a weight;

using the original image data value to access a second one-dimensional look-up table to acquire an initial compensated image data value; and multiplying the weight by the initial compensated image data value to produce a compensated image data value.

13. An apparatus, comprising:

a source of original image data;

a display panel of individual elements;

a backlight of individual lighting elements;

two one-dimensional look-up tables having compensated image data;

a processor to:

determine a backlight image value for each individual element; and adjust the original image data to compensate for the backlight value and produce compensated image data by using the backlight value as an index into a first of the two look-up tables to acquire a weight and the original image data value as an index into a second of the two look-up tables to acquire an initial compensated image data value.

* * * * *